US005179854A

United States Patent [19]

Matsui et al.

[11] Patent Number: 5,179,854

[45] Date of Patent: Jan. 19, 1993

[54] PROCESS FOR PRODUCTION OF DRAW-IRONED CAN

[75] Inventors: Kenzo Matsui, Hirano; Katsuhiro Imazu, Yokohama, both of Japan

[73] Assignee: Toy Seikan Kaisha Ltd., Tokyo, Japan

[21] Appl. No.: 635,504

[22] PCT Filed: May 17, 1990

[86] PCT No.: PCT/JP90/00629

§ 371 Date: Mar. 13, 1991

§ 102(e) Date: Mar. 13, 1991

[87] PCT Pub. No.: WO90/14179

PCT Pub. Date: Nov. 29, 1990

[30] Foreign Application Priority Data

May 17, 1989 [JP] Japan ..... 1-121476

[51] Int. Cl.[5] ..... B21D 22/28

[52] U.S. Cl. ..... 72/349; 72/379.4

[58] Field of Search ..... 72/347, 349, 379.4

[56] References Cited

U.S. PATENT DOCUMENTS

| | | | |
|---|---|---|---|
| 4,346,580 | 8/1982 | Saunders | 72/349 |
| 4,425,778 | 1/1984 | Franek et al. | 72/349 |
| 4,962,659 | 10/1990 | Imazu et al. | 72/349 |
| 5,014,536 | 5/1991 | Saunders | 72/349 |

*Primary Examiner*—Lowell A. Larson

*Attorney, Agent, or Firm*—Sughrue, Mion, Zinn, Macpeak & Seas

[57] ABSTRACT

In a process for the production of a draw-ironed can, supposing that at the draw-ironing step, the blank thickness is A, the maximum thickness of the side wall of a cup-shaped body obtained by draw working of the first stage is B and the maximum thickness of the side wall of a cup-shaped body obtained by redraw working of the second stage is C, the increase of thickness B is controlled to up to 20% of thickness A and the increase of thickness C is controlled to up to 30% of thickness A, and supposing that the final thickness of the side wall of the draw-ironed can finally obtained by ironing working is D, the thickness reduction ratio of the side wall of the obtained draw-ironed can satisfies the following requirements:

$$(B-D)/B\times 100\leqq 70\%,$$

and $$(C-D)/C\times 100\leqq 70\%.$$

According to this process, the surface roughness of the final can body is improved, barrel breaking is prevented at the ironing step, and a draw-ironed can having improved necking workability and flanging workability is obtained.

4 Claims, 4 Drawing Sheets

BLANK

DRAWING OF FIRST STAGE

REDRAWING OF SECOND STAGE

IRONING

PROCESS FOR PRODUCTION OF DRAW-IRONED CAN

DESCRIPTION

Technical Field

The present invention relates to a process for the production of a draw-ironed can. More particularly, the present invention relates to a process for the production of a draw-ironed can, in which the final can body is improved in the surface roughness and the necking workability and flanging workability are improved.

Background Art

Draw-ironed cans (sometimes referred to as "DI cans" hereinafter) formed of a tin-deposited steel sheet (tinplate) or an aluminum sheet are used in large quantities for beer cans and carbonated drink cans. These DI cans are prepared by draw-forming a metal blank into a cup having a relatively large diameter, redrawing the cup into a cup having a small diameter and subjecting the side wall portion of the cup to ironing working 2 or 3 times. According to need, the prepared DI cans are subjected to single-stage or multiple-stage necking working of reducing the diameter of the opening and then to flanging working to obtain can bodies to which easy-open lids are wrap-seamed.

In the production of DI cans, draw-forming and redrawing are indispensable steps. At this draw-redraw forming, the metal sheet shows such a plastic flow that the dimension increases in the height direction of the cup but the dimension decreases in the circumferential direction of the cup. Accordingly, in a cup obtained by draw-redraw forming, there is observed a tendency that the thickness of the side wall portion gradually increases toward the top from the bottom and the thickness is extremely large at the top end (open end) of the side wall portion.

Accordingly, the following defects are brought about when the above-mentioned redraw-formed cup is subjected to ironing working.

At the ironing step, the thickness of the side wall portion of the can is determined by the clearance between the radius of the outer surface of the punch and the radius of the inner surface of the die, and the thickness of the side wall portion is constant from the lower portion to the upper portion. However, the thickness of the upper portion of the cup is larger than the thickness in the lower portion. Accordingly, the ironing condition is severe and the thickness reduction ratio is high. At a high ironing ratio, barrel breaking is often caused at the ironing step, and wrinkling and flange cracking are often caused in the upper portion where necking working and flanging working are performed, resulting in occurrence of insufficient sealing (leakage). Moreover, the surface of the side wall of the can becomes rough and the metallic gloss is degraded, and in order to prevent the exposure of the metal, a coating having a larger thickness becomes necessary.

Application of an organic paint to the metal blank in advance or lamination of an organic resin film on the metal blank in advance, instead of formation of a coating on the formed DI can, is desirable in view of the productivity and environmental sanitation. However, the conventional draw-ironing process is defective in that the adhesion of the organic coating is drastically reduced in the upper portion of the side wall and the metal exposure measured as the enamel rater value (ERV) becomes extraordinarily large.

DISCLOSURE OF THE INVENTION

It is therefore a primary object of the present invention to provide a draw-ironed can where the above-mentioned defects of the conventional technique are overcome.

Another object of the present invention is to provide a draw-ironed can where the surface roughness of the final can body is improved, barrel breaking is prevented at the ironing step and the necking workability and flanging workability are improved.

Still another object of the present invention is to provide a process for the preparation of a draw-ironed can, in which the thickness reduction ratio at the ironing step is controlled to a relatively uniform level throughout the side wall of the cup from the lower portion to the upper portion.

A further object of the present invention is to provide a process especially suitable for the draw-ironing working of a precoated metal blank.

In accordance with the present invention, there is provided a process for the production of a draw-ironed can, characterized in that supposing that at the draw-ironing step, the blank thickness is A, the maximum thickness of the side wall of a cup-shaped body obtained by draw working of the first stage is B and the maximum thickness of the side wall of a cup-shaped body obtained by redraw working of the second stage is C, increase of thickness B is controlled to up to 20% of thickness A and the increase of thickness C is controlled to up to 30% of thickness A, and that supposing that the final thickness of the side wall of the draw-ironed can finally obtained by ironing working is D, the thickness reduction ratio of the side wall of the obtained draw-ironed can satisfies the following requirements:

$$(B-D)/B\times 100\leqq 70\%,$$

and $$(C-D)/C\times 100\leqq 70\%.$$

When the present invention is applied to a precoarted metal blank, particularly a thin metal sheet laminated with a polyester resin film, especially prominent effects can be attained.

As the means for controlling the increase of the thickness B and the increase of thickness C within the above-mentioned ranges, in the present invention, there is preferably adopted a method in which redrawing working is carried out in at least one stage by holding a preliminarily drawn cup between an annular holding member inserted into the cup and a redrawing die, and relatively moving a redrawing punch, which is arranged coaxially with the holding member and redrawing die so that the redrawing punch can enter in the holding member and come out therefrom, and the redrawing die so that they are engaged with each other, to draw-form the preliminarily drawn cup into a deep-draw-formed cup having a diameter smaller than that of the preliminarily drawn cup, wherein the curvature radius ($R_D$) of the working corner of the redrawing die is 1 to 2.9 times the thickness ($t_B$) of the metal blank, the curvature radius ($R_H$) of the holding corner of the holding member is 4.1 to 12 times the thickness ($t_B$) of the metal blank, flat engaging portions of the holding member and redrawing die with the preliminarily drawn cup have a dynamic friction coefficient of from 0.001 to 0.2, and the redraw ratio defined by the ratio of the diameter of the preliminarily drawn cup to the diameter of the redrawn cup is in the range of from 1.1 to 1.5. However, the redrawing means that can be adopted in the present invention is not limited to the above-mentioned method.

Referring to FIG. 1 showing shapes and dimensions of formed bodies at respective steps of the process for the production of a draw-ironed can according to the present invention, a blank 100 has a thickness A. A preliminarily cup 101 obtained by draw working of the first stage has a diameter larger than that of a final draw-ironed can, and a bottom wall 102 has the same thickness as the thickness A of the blank 100 but the thickness of a top portion 103 of the side wall is increased to the maximum thickness B by compression plastic flow. A redrawn cup 104 obtained by redrawing working of the second stage has a diameter substantially equal to that of the final draw-ironed can and a bottom wall has the same thickness as the thickness A of the blank, but the thickness of a top portion of the side wall is increased to the maximum thickness C by compression plastic flow by the redrawing of the second stage. A can 107 has the thickness A at a bottom 108, but a side wall 109 has a uniform thickness D controlled by the ironing working.

According to the present invention, the above-mentioned objects are attained by controlling the increase of the thickness B to up to 20%, preferably up to 15%, of the thickness A, controlling the increase of the thickness C to up to 30%, preferably up to 25%, of the thickness A, and controlling the final thickness of the side wall at the ironing working so that the following requirements are satisfied:

$$(B-D)/B\times 100\leqq 70\% \quad (1)$$

and $$(C-D)/C\times 100\leqq 70\% \quad (2)$$

As the result of our research, it has been found that in the conventional draw-ironing working process, the increases of the thickness B is about 24 to about 25% of the thickness A, and in this case, it is difficult to control the increase of the thickness C to up to 30% of the thickness A. In the conventional process, the increase of the thickness C is about 33 to about 34% of the thickness A, and in this case, the thickness reduction ratio in the portion of the thickness C by the ironing process is excessively high and such defects as barrel breaking at the ironing, wrinkling and cracking at the necking working and flanging working and increase of the surface roughness are brought about. In the present invention, control of the increase of the thickness within the above-mentioned range is absolutely necessary for controlling the increase of the thickness C to up to 30% of the thickness A, but this is not sufficient for preventing occurrence of the above-mentioned defects of the conventional process. In the present invention, all of the defects of the conventional process can be completely overcome by controlling the increase of the thickness C up to 30% of the thickness A.

In the present invention, it also in important that at the ironing working, the final thickness D of the side wall of the can should be set so that the requirements of formulae (1) and (2) are satisfied. If the thickness reduction ratios expressed by the left-hand sides of formulae (1) and (2) exceed 70%, barrel breaking, generation of wrinkles or cracks at the necking or flanging working and increase of the surface roughness are caused.

DETAILED DESCRIPTION OF THE PREFERRED EMBODIMENTS

Figure 1A:
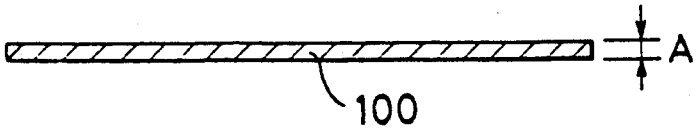
FIGS. 1(A) through 1(D) are diagrams illustrating drawing and ironing steps.
Figure 1B:
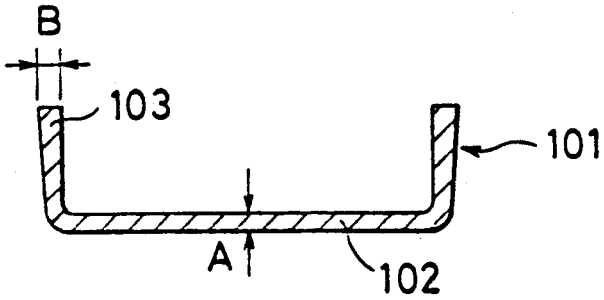
Figure 1C:
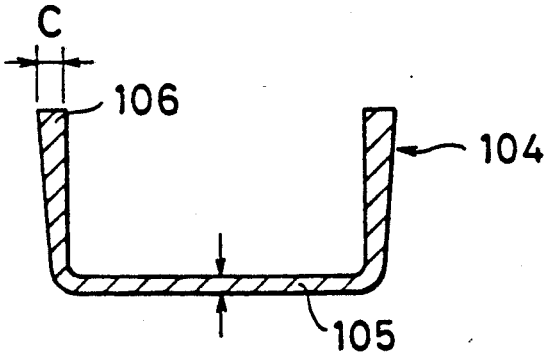
Figure 1D:
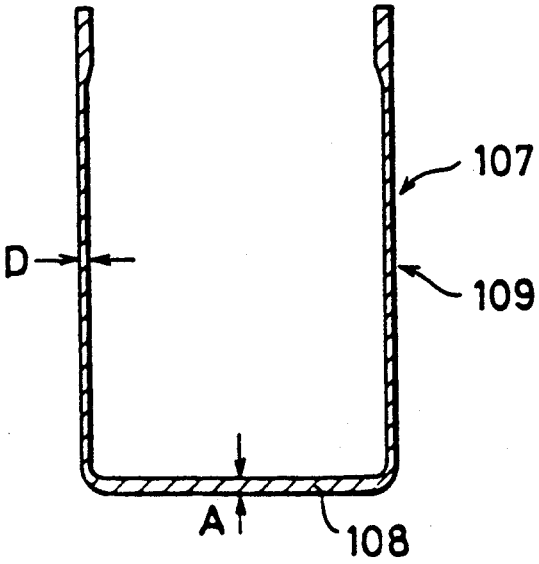
Figure 2:
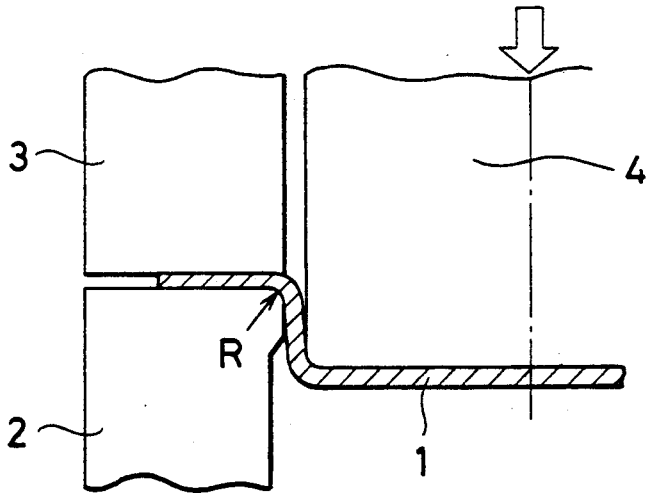
FIGS. 2 and 3 are sectional views illustrating the main part at the drawing working.

Referring to FIG. 2 illustrating the preliminarily drawing method used in the present invention, a coated or uncoated metal sheet 1 is held by a preliminarily drawing die 2 and a blank holder 3, and the metal sheet 1 is formed into a preliminarily drawn cup by a punch 4 moving relatively to the preliminarily drawing die 2 so that the punch 4 is engaged with the preliminarily drawing die 2. In the present invention, in order to control the increase of the thickness B to up to 20% of the thickness A, the curvature radius R of the corner of the preliminarily drawn cup is adjusted to 3.0 to 15.0 times the blank thickness A, especially 3.5 to 12.0 times the blank thickness by bending elongation of the side wall is effectively attained and the difference of the thickness between the lower and upper portions of the side wall is diminished.

Figure 3:
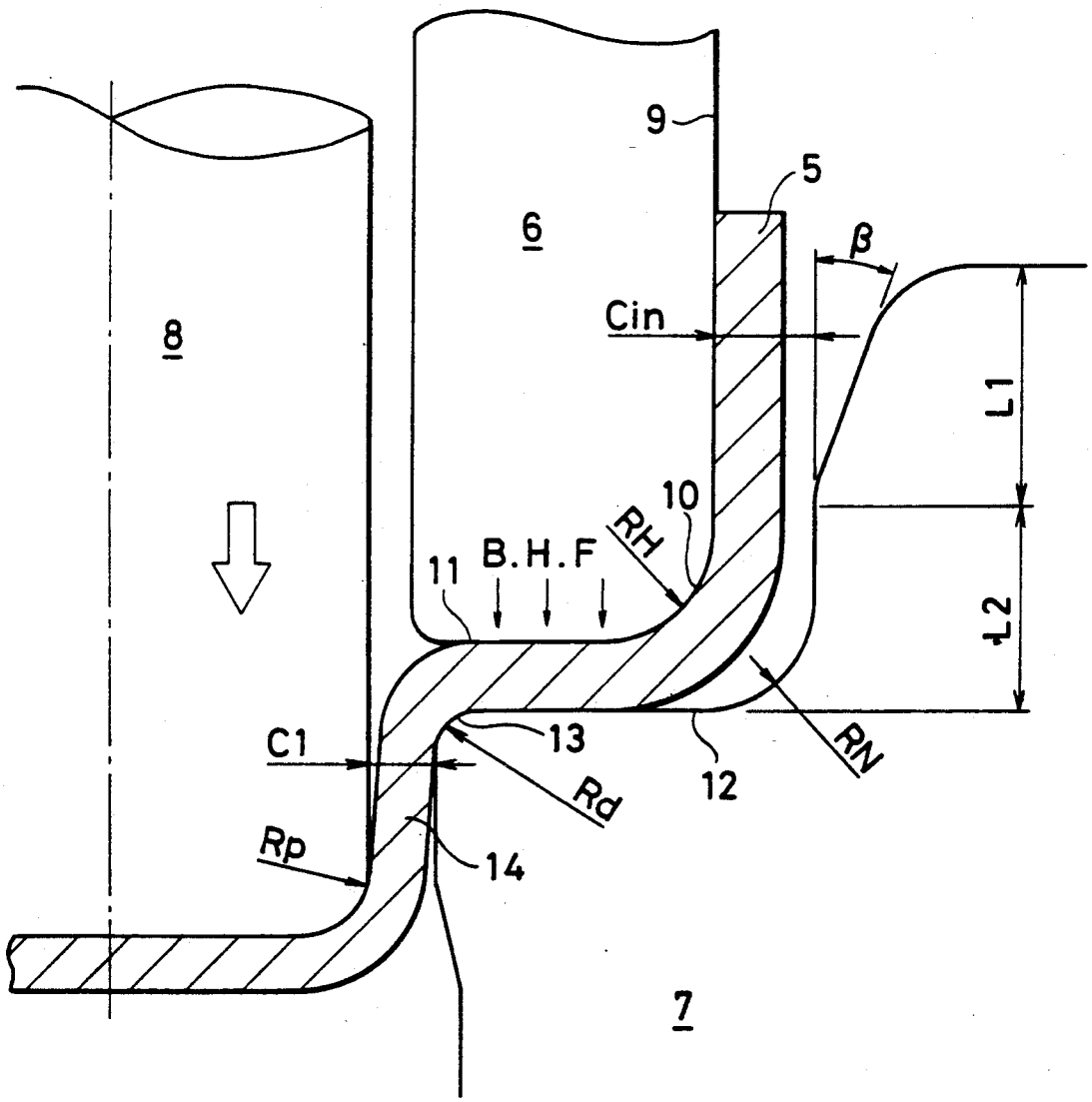

Referring to FIG. 3 illustrating the redrawing method used in the present invention, the preliminarily drawn cup 5 formed by the above-mentioned preliminarily drawing method is held by an annular holding member 6 inserted into this cup and a redrawing die 7 located below the holding member 6. A redrawing punch 8 is arranged coaxially with the holding member 6 and redrawing die 7 so that the redrawing punch 8 can enter into the holding member 6 and come out therefrom. The redrawing punch 8 and redrawing die 7 are relatively moved so that they are engaged with each other.

By this redrawing, the side wall of the preliminarily drawn cup 5 is passed through a curvature corner 10 of the annular holding member 6 from a peripheral surface 9 thereof, bent vertically inwardly of the radius, passed through a portion defined by an annular bottom face 11 of the annular holding member 6 and a top face 12 of the redrawing die 7 and bent substantially vertically in the axial direction by a working corner 13 of the redrawing die 7 to form a deep-draw-formed cup 14 having a diameter smaller than that of the preliminarily drawn cup 5, and simultaneously, the side wall is bend-elongated to reduce the thickness of the side wall.

In this case, if the curvature radius ($R_D$) of the working corner of the redrawing die is adjusted to 1 to 2.9 times the thickness A of the metal blank, especially 1.5 to 2.9 times the thickness A of the metal blank, reduction of the thickness by bending elongation of the side wall is effectively accomplished and simultaneously, the difference of the thickness between the lower and upper portions is diminished and uniform thickness reduction is attained in the entire side wall, while controlling the increase of the thickness C to up to 30% of the thickness A.

Figure 4:
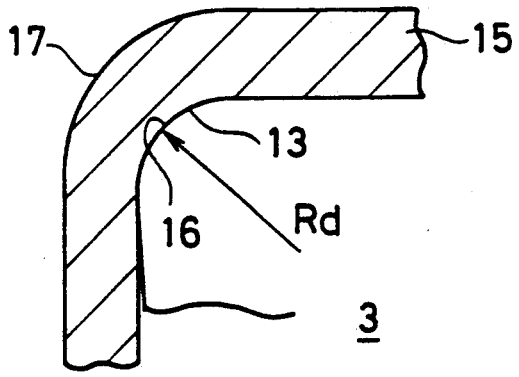
FIG. 4 is a sectional view illustrating the corner portion at the drawing step.

Referring to FIG. 4 illustrating the principle of bending elongation, a metal sheet 15 is forcibly bent along a working corner of a redrawing die having a curvature radius $R_D$ under a sufficient back tension. In this case, no strain is produced on a surface 16 of the metal sheet 15 on the side of the working corner, but a surface 17 on the side opposite to the working corner undergoes a strain by pulling. The quantity $\epsilon_s$ of this strain is given by the following formula:

$$\epsilon_s = \frac{2\pi(R_D + t) - 2\pi R_D}{2\pi R_D} = \frac{t}{R_D} \quad (3)$$

wherein $R_D$ represents the curvature radius of the working corner and t represents the sheet thickness.

The surface (inner surface) 17 of the metal sheet is elongated by $\epsilon_s$ by the working corner but the other surface (outer surface) is elongated in the same quantity as $\epsilon_s$ just below the working corner by the back tension. Since the metal sheet is thus bend-elongated, the thickness of the metal sheet is reduced, and the thickness change ratio $\epsilon_t$ is given by the following formula:

$$\epsilon_t = \frac{-t}{R_D + t} \quad (4)$$

From this formula (4), it is seen that reduction of the curvature radius $R_D$ of the working corner is effective for reducing the thickness of the metal sheet, that is, the smaller $R_D$, the larger is $|\epsilon_t|$. Furthermore, it is seen that if the curvature radius $R_D$ of the working corner is constant, the larger is the thickness t of the metal sheet passed through the working corner, the larger is the thickness change $|\epsilon_t|$.

Figure 5:
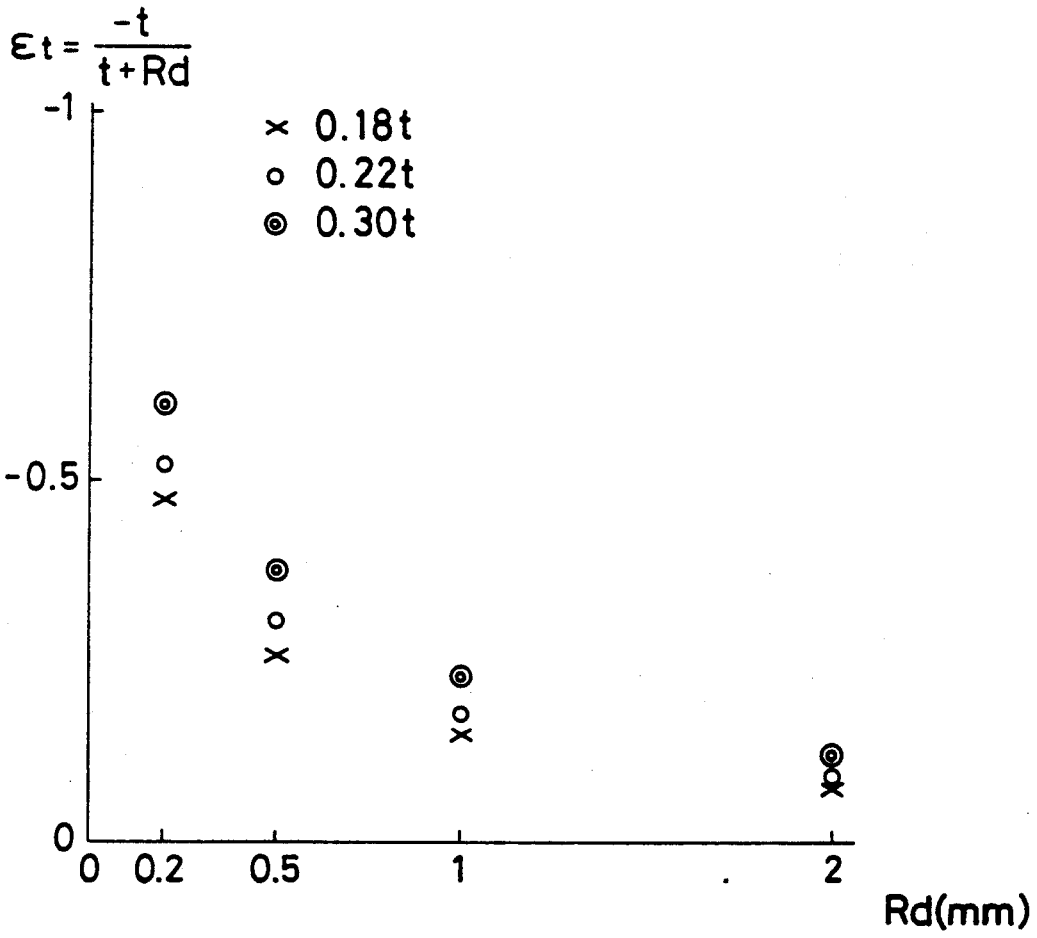
FIG. 5 is a plot diagram where the curvature radius Rd of the corner portion shown in FIG. 4 is plotted on the abscissa and the thickness change ratio at is plotted on the ordinate while the thickness t is changed.

FIG. 5 is a graph in which the curvature radius $R_D$ of the working corner is plotted on the abscissa and the thickness change ratio $\epsilon_t$ is plotted on the ordinate while changing the thickness t of the metal sheet. This curve obviously indicates the above-mentioned fact.

Supposing that the thickness of the metal sheet supplied to the working corner is $t_o$ and the thickness of the sheet having the thickness reduced by bending elongation is $t_1$, this thickness $t_1$ is given by the following formula:

$$t_1 = t_o\left[1 - \frac{t_o}{t_o R_D}\right] \quad (5)$$

incidentally, in the upper portion of the side wall of the preliminarily drawn cup, the thickness is increased over the standard thickness (blank thickness) $t_B$ by the influence of the compression in the radial direction and this thickness is given by the following formula:

$$T_o = (1+\alpha)t_B \quad (6)$$

wherein $\alpha$ represents the thickness index.

Therefore, the reduced thickness $t_1$ is given by the following formula:

$$t_1 = (1+\alpha)t_B\left(1 - \frac{(1+\alpha)t_B}{(1+\alpha)t_B + R_D}\right) = \frac{R_D}{(1+\alpha)t_B + R_D}\cdot(1+\alpha)t_B \quad (7)$$

The ratio of $t_1$ in case of $\alpha=0$ to $t_1$ in case of $\alpha\neq 0$ is given by the following formula:

$$\text{Ratio} = \frac{t_1\alpha \neq 0}{t_1\alpha = 0} = \frac{(1+\alpha)t_B + (1+\alpha)R_D}{(1+\alpha)t_B + R_D} \quad (8)$$

From formula (8), it is understood that reduction of $R_D$ exerts the function of controlling the variation ratio of the thickness in the bend-elongated side wall to a small value. More specifically, in the case where $t_B$ is 0.18 mm and $\alpha$ is 0.1, if $R_D$ is 2 mm, Ratio is 1.091 but if $R_D$ is 0.5 mm, Ratio is 1.072. Thus, it is understood that reduction of $R_D$ is prominently effective for controlling the variation of the thickness and uniformalizing the thickness.

In other words, since the ratio of the thickness of the preliminarily drawn cup to the standard thickness ($t_S$) is $1+\alpha$, the thickness variation-controlling ratio is given by the following formula:

$$(1+\alpha) - \text{Ratio} = \frac{\alpha(1+\alpha)t_B}{(1+\alpha)t_B + R_D} \quad (9)$$

When the value of formula (9) is calculated with respect to the above-mentioned instance, it is seen that the value is 0.009 in case of $R_D=2$ mm and is 0.028 in case of $R_D=0.5$ mm, and that the effect attained in the latter case is about 3.2 times as high as the effect attained in the former case.

As is apparent from the foregoing illustration, the present invention is based on the finding that reduction of the curvature radius ($R_D$) of the working corner of the redrawing die is effective for uniformalizing the thickness of the side wall after the bending elongation. In the case where the value of $R_D$ is too large and exceeds the above-mentioned range, the degree of the thickness reduction of the side wall and the uniformity of the thickness of the side wall are insufficient. On the other hand, if the value of $R_D$ is too small and below the above-mentioned range, breaking of the blank is readily caused in the working corner of the die at the redrawing step and the objects of the present invention are hardly attained.

In the present invention, it is preferred that draw-forming be then carried out so that the curvature radius ($R_H$) of the holding corner 10 of the holding member 6 is 4.1 to 12 times, especially 4.1 to 11 times, the thickness ($t_B$) of the metal blank, flat engaging portions of the holding member 6 and redrawing die 7 with the preliminarily drawn cup have a dynamic friction coefficient (u) of 0.001 to 0.20, especially 0.001 to 0.10, and the draw ratio defined by the ratio of the diameter of the shallow-draw-formed cup to the diameter of the deep-draw-formed cup is 1.1 to 1.5, especially 1.15 to 1.45.

In order to perform sufficient bending elongation by the working corner of the redrawing die, it is indispensable that a back tension should be applied so that the metal sheet is supplied while the metal sheet is bent precisely along this working corner. This back tension is given by the sum of (1) the forming load on the flat sheet at the side wall of the preliminarily drawn cup, (2) the substantial blank holding load and (3) the resisting load against deformation of the preliminarily drawn cup to the deep-draw-formed cup. Of course, the sum of these forces should not be so large as causing breaking of the metal sheet but should be such that blending elongation can be effectively accomplished. Furthermore, a certain balance should be maintained among these three forces.

The curvature radius $R_H$ of the holding corner 10 participates in the above-mentioned forming load (1) and the formability. Namely, if the curvature radius $R_H$ is below the above-mentioned range, breaking of the sheet and damage of the surface are often caused. If the curvature radius $R_H$ exceeds the above-mentioned range, wrinkles are readily formed. Thus, if $R_H$ is outside the above-mentioned range, redraw forming is not satisfactorily performed. However, if this curvature radius $R_H$ is controlled within the above-mentioned range, redraw forming can be performed smoothly while giving a sufficient back tension.

The dynamic friction coefficients ($\mu$) of the annular surface 11 of the holding member 6 and the annular face 12 of the redrawing die 7 participate in the above-mentioned substantial blank holding force (2). The substantial blank holding force is a force effectively acting for controlling wrinkles generated with the contraction of the size of the metal sheet in the circumferential direction thereof, which is represented by the product of the force applied between the holding member and redrawing die and the dynamic friction coefficient ($\mu$) of the above-mentioned surfaces. If the dynamic friction coefficient ($\mu$) exceeds the above-mentioned range, necking breaking of the metal sheet is readily caused, and if the dynamic friction coefficient ($\mu$) is below the above-mentioned range, formation of wrinkles cannot be controlled. However, if the dynamic friction coefficient ($\mu$) is adjusted within the above-mentioned range, it is possible to give a back tension necessary for bending elongation while controlling formation of wrinkles or breaking of the metal sheet.

The redraw ratio defined by the ratio of the diameter (b) of the shallow-draw-formed cup to the diameter (a) of the deep-draw-formed cup participates in the above-mentioned deformation-resisting load (3). If this redraw ratio (b/a) is below the above-mentioned range, it is difficult to obtain a deep-draw-formed can and it also is difficult to impart a large back tension necessary for bending elongation. If the redraw ratio (b/a) exceeds the above-mentioned range, the deformation resistance is too large and breaking of the bending elongation is often caused. By adjusting the redraw ratio (b/a) within the above-mentioned range, deep-draw forming can be performed at a high efficiency, breaking of the metal sheet can be prevented, and a back tension necessary for high bending elongation can be given.

As is apparent from the foregoing description, by adjusting the curvature radius ($R_D$) of the corner portion of the redrawing die to a small value, adjusting the curvature radius ($R_H$) of the corner portion of the holding member to a large value, adjusting the dynamic friction coefficient ($\mu$) of the holding member and die and the redraw ratio (b/a) within specific ranges and adjusting these conditions integrally, deep-draw forming, reduction of the thickness of the side wall and uniformalization of the thickness can be attained. In this case, if redraw forming is carried out in a plurality of stages, for example, up to 4 stages, the thickness of the side wall is more uniformalized.

According to the present invention, a deep-draw-formed can having an entire draw ratio of 0.2 to 4.0, especially 2.0 to 3.5, can be obtained. The draw ratio referred to herein is a value given by the following formula:

$$\text{Draw ratio} = \frac{\text{(diameter of blank)}}{\text{(diameter of deep-draw-formed can)}} \quad (10)$$

Furthermore, the thickness of the side wall of the redrawn cup can be reduced to 60 to 95%, especially 65 to 90%, of the blank thickness ($t_B$) on the average, and the increase of the thickness C can be controlled to up to 30%, especially up to 25%, of the thickness A.

At draw forming or redraw forming, preferably, a coated or uncoated metal sheet or a cup is coated with an aqueous lubricant formed by dispersing a surface active agent or oil.

Draw forming can be carried out at room temperature, but it is generally preferred that draw forming be carried out at a temperature of 20° to 95° C., especially 20° to 90° C.

Then, ironing working is carried out in a single stage or a plurality of stages by using an ironing punch and an ironing die in combination so that the thickness D of the side wall satisfies the requirements of formulae (1) and (2). It is preferred that the entire ironing ratio, that is, the total ironing ratio $R_I$ defined by the following formula:

$$R_I = \frac{A - D}{A} \times 100 \quad (11)$$

be at least 40%, especially at least 50%. At ironing working, it is preferred that cooling and lubrication be effected by supplying an aqueous lubricant formed by dispersing a surface active agent or oil in water to the redrawn cup and the ironing die.

The formed can is subjected to various workings such as doming, necking and flanging to obtain a can barrel for a two-piece can.

In the present invention, various surface-treated steel sheets and sheets of light metals such as aluminum can be used as the metal sheet.

As the surface-treated steel sheet, there can be used steel sheets obtained by annealing a cold-rolled steel sheet, subjecting the annealed sheet to secondary cold rolling and subjecting the cold-rolled steel sheet to at least one surface treatment selected from zinc deposition, tin deposition, nickel deposition, electrolytic chromate treatment and chromate treatment. As a preferred example of the surface-treated steel plate, there can be mentioned an electrolytically chromate-treated steel sheet, and an electrolytically chromate-treated steel sheet comprising 10 to 200 mg/m$^2$ of a metallic chromium layer and 1 to 50 mg/m$^2$ (calculated as metallic chromium) of a chromium oxide layer is especially preferably used because this steel sheet is excellent in the combination of the coating adhesion and corrosion resistance. Another example of the surface-treated steel sheet is a hard tinplate having a deposited tin amount of 0.5 to 11.2 g/m$^2$, and preferably, this tinplate is subjected to a chromate treatment or a chromate/phosphate treatment so that the deposited chromium amount is 1 to 30 mg/m$^2$ as metallic chromium.

Not only a so-called pure aluminum sheet but also an aluminum alloy sheet can be used as the light metal sheet. An aluminum alloy sheet having excellent corrosion resistance and workability comprises 0.2 to 1.5% by weight of Mn, 0.8 to 5% by weight of Mg, 0.25 to 0.3% by weight Zn and 0.15 to 0.25% by weight of Cu, the balance being aluminum. When these light metal sheets are precoated, it is preferred that they be subjected to a chromate treatment or a chromate/phosphate treatment so that the chromium amount is 20 to 300 mg/m$^2$ as metallic chromium.

The blank thickness A of the metal sheet differs according to the kind of the metal and the use or size of the vessel. However, it is generally preferred that the blank thickness be 0.10 to 0.50 mm, and it is especially preferred that the blank thickness A be 0.10 to 0.30 mm in case of a surface-treated steel sheet or 0.15 to 0.40 mm in case of a light metal sheet.

The above-mentioned metal sheet can be directly used, but if a protecting coating of a resin is formed on the metal sheet prior to draw forming, deep draw forming and ironing working can be performed without substantial damage of the protecting coating layer. The protecting coating can be formed by applying a protecting paint or laminating a thermoplastic resin film.

An optional protecting paint comprising a thermosetting resin or thermoplastic resin can be used as the protecting paint. For example, there can be mentioned modified epoxy paints such as a phenol-epoxy resin and an amino-epoxy paint, vinyl and modified vinyl paints such as a vinyl chloride/vinyl acetate copolymer, a partially saponified vinyl chloride/vinyl acetate copolymer, a vinyl chloride/vinyl acetate/maleic anhydride copolymer, an epoxy-modified vinyl paint, an epoxy/amino-modified vinyl paint and an epoxy/-phenol-modified vinyl paint, acrylic resin paints, and synthetic rubber paints such as styrene/butadiene copolymer. These paints can be used singly or in the form of a mixture of two or more of them.

These paints are applied to a metal blank in the form of an organic solvent solution such as an enamel or a lacquer or an aqueous dispersion or aqueous solution by roller coating, spray coating, dip coating, electrostatic coating or electrophoretic deposition. Of course, if the resin paint is a thermosetting paint, the paint can be baked according to need. In view of the corrosion resistance and workability, it is preferred that the thickness of the protecting coating be 2 to 30 μm, especially 3 to 20 μm (dry state). Moreover, in order to improve the drawing-redrawing workability, a lubricant can be incorporated into the coating.

As the thermoplastic resin film to be laminated, there can be mentioned films of olefin resins such as polyethylene, polypropylene, an ethylene/propylene copolymer, an ethylene/vinyl acetate copolymer, an ethylene/acrylic ester copolymer and an ionomer, films of polyesters such as polyethylene terephthalate, polybutylene terephthalate and an ethylene terephthalate/isophthalate copolymer, films of polyamides such as nylon 6, nylon 6,6, nylon 11 and nylon 12, a polyvinyl chloride film, and polyvinylidene chloride film. These films may be undrawn films or biaxially drawn films. It is generally preferred that the thickness of the thermoplastic film be 3 to 50 μm, especially 5 to 40 μm. Lamination of the film on the metal sheet can be accomplished by fusion bonding, dry lamination or extrusion coating, and if the adhesiveness (heat fusion bondability) between the film and metal sheet is poor, for example, a urethane adhesive, an epoxy adhesive, an acid-modified olefin adhesive, a copolyamide adhesive or a copolyester adhesive can be interposed between them.

An inorganic filler (pigment) can be incorporated into the coating or film to be used in the present invention for hiding the metal sheet and assisting the transmission of the blank-holding force to the metal sheet at the drawing-redrawing forming.

As the inorganic filler, there can be mentioned inorganic white pigments such as rutile titanium oxide, anatase titanium oxide, zinc flower and gloss white, white extender pigments such as baryte, precipitated baryte sulfate, calcium carbonate, gypsum, precipitated silica, aerosil, talc, calcined clay, uncalcined clay, barium carbonate, alumina white, synthetic mica, natural mica, synthetic calcium silicate and magnesium carbonate, black pigments such as carbon black and magnetite, red pigments such as red iron oxide, yellow pigments such as sienna, and blue pigments such as ultramarine and cobalt blue. The inorganic filler can be incorporated in an amount of 10 to 500% by weight, especially 10 to 300% by weight, based on the resin.

Figure 6:
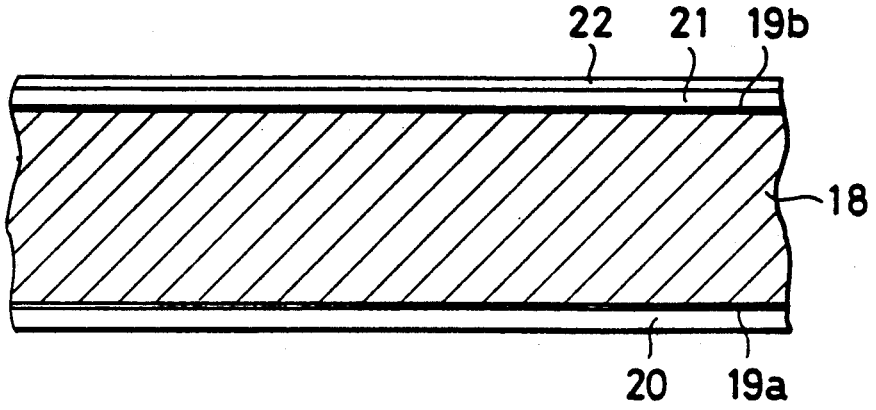
FIG. 6 is a sectional view showing a coated metal sheet used in the present invention.

FIG. 6 shows an example of the coated metal sheet preferably used in the present invention. Formation films 19*a* and 19*b* such as chromate-treated films are formed on both the surfaces of a metal substrate 18, and an inner face coating 20 is formed on the surface, to be formed into an inner surface of the can, through the formation film 19*a*, and on the surface to be formed into an outer surface of the can, an outer face coating comprising a white coating 21 and a transparent varnish 22 is formed through the formation film 19*b*.

The top layer 20 on the surface to be formed into an inner surface of the DI can is preferably formed of a polyester film. The polyester resin coating layer comprises ethylene terephthalate units in an amount of 75 to 99% of total ester recurring units, remaining 1 to 25% of ester recurring units being derived from at least one acid component selected from the group consisting of phthalic acid, isophthalic acid, terephthalic acid, succinic acid, azalaic acid, adipic acid, sebacic acid, dodecadionix acid, diphenylcarboxylic acid 2,6-naphthalene-dicarboxylic acid, 1,4-cyclohexane-dicarboxylic acid and trimellitic anhydride, and at least one saturated polyhydric alcohol selected from the group consisting of ethylene glycol, 1,4-butanediol, 1,5-pentanediol, 1,6-hexanediol, propylene glycol, polytetramethylene glycol, trimethylene glycol, triethylene glycol, 1,4-cyclohexane dimethanol, trimethylolpropane and pentaerythritol. This polyester resin is formed into a film by a known extruder and is used as an undrawn polyester resin film, but in order to improve the barrier property of the polyester resin film, it is preferred that the formed film be drawn in both of the longitudinal direction and the lateral direction and be then thermally set. The thickness of the polyester resin film is not particularly critical, but preferably, the thickness of the polyester resin film is 10 to 50 μm. If the thickness is smaller than 10 μm, the lamination adaptability is drastically degraded, and the workability is insufficient and the film cannot follow up with DI working. If the thickness exceeds 50 μm, the polyester resin film is economically advantageous over epoxy pains widely used in the filed of manufacture of cans. It is preferred that the softening-initiating temperature of the polyester resin film be in the range of from 170° to 235° C. By the softening-initiating temperature referred to herein is meant the temperature at which the needle begins to penetrate into the polyester resin film when the temperature is elevated at a rate of 10° C./min by using a thermal mechanical analysis apparatus (TMA100 supplied by Seiko Denshi Kogyo). If the softening-initiating temperature is higher than 235° C., the workability of the polyester resin film is degraded and a great number of cracks are formed at the DI working. On the other hand, if the softening-initiating temperature is lower than 170° C., when the outer surface is printed after the DI working and the print layer is baked, since the baking temperature is higher than the softening-initiating temperature of the polyester resin film, the operation adaptability is drastically degraded and the polyester resin film cannot be practically used. Also the crystal-melting temperature of the polyester resin film is important, and it is preferred that this temperature be in the range of from 190° to 250° C. By the crystal-melting temperature referred to herein is meant the temperature at which the maximum peak depth of the endothermic peak is observed when the temperature is elevated at a rate of 10° C./min by a differential scanning calorimeter (SS10 supplied by Seiko Denshi Kogyo). If the crystal-melting temperature of the polyester resin film is higher than 250° C., the polyester resin film per se becomes very rigid and the workability is drastically degraded. If the crystal melting temperature is lower than 190° C., the heat resistance of the polyester resin film per se is degraded, and when heating is effected by outer surface printing or the like, the mechanical strength is drastically degraded, and necking and flanging to be conducted afterward are impeded.

Also the orienting property of the polyester resin film is a factor important for deciding the workability of the polyester resin film. Namely, it is especially preferred that the in-plane orientation coefficient be in the range of from 0 to 0.100. The in-plane orientation coefficient referred to herein is determined by a refractometer and is defined by (refractive index in longitudinal direction refractive index in lateral direction)÷2—refractive index in thickness direction.

If the in-plane orientation coefficient is larger than 0.100, the workability of the polyester film is drastically degraded and a great number of cracks are formed at the ironing working, and the polyester resin film cannot be practically used. Also the mechanical properties of the polyester resin film are important, and it is especially preferred that the elongation at break of the polyester resin film be 150 to 500% and the strength at break be 3 to 18 kg/mm$_2$. The elongation at break and strength at break of the polyester resin can be determined by carrying out the tensile test at a constant temperature of 25° C. at a pulling speed of 100 mm/min by an ordinary tensile tester.

If the elongation at break of the polyester resin film is lower than 150%, the workability of the polyester resin film is drastically degrated and cracks are readily formed by a severe ironing working such at the DI working. If the elongation at break is higher than 500%, thickness unevenness is readily caused at the formation of the film and because of this thickness unevenness, the film is easily damaged at an ironing working such as the DI ironing. Similar phenomena are observed with respect to the strength at break of the polyester resin film. If the strength at break is higher than 18 kg/mm$^2$, the workability and adhesion of the polyester resin film are drastically degraded, and cracking and peeling are readily caused by ironing. If the strength at break is lower than 3 kg/mm$^2$, since the toughness is lost in the polyester resin film and scratches are readily formed in the polyester resin film at the can-manufacturing step, with the result that the polyester resin film is damaged from such scratches if ironing is finally carried out. It is preferred that the formation films 19*a* and 19*b* as the adhesion undercoat below the polyester resin coating layer be chromium oxide hydrate layers. This chromium oxide hydrate layer can be formed by applying a known chromate treatment to a steel sheet, a steel sheet deposited with tin, nickel, chromium, zinc or aluminum, a steel sheet deposited with an alloy of such metals, a steel sheet deposited with a plurality of layers of such metals, or a metal sheet formed by depositing a metal as mentioned above on a steel sheet and heat-treating the metal-deposited steel sheet to form a metal diffusion layer on the surface of the steel sheet. In view of the adhesion and corrosion resistance of the polyester resin coating layer after the DI processing, it is preferred that the chromium oxide hydrate layer be present in an amount of 0.005 to 0.050 g/m$^2$, especially 0.010 to 0.030 g/m$^2$, as metallic chromium. If the amount of the chromium oxide hydrate layer is smaller than 0.005 g/m$^2$ or larger than 0.050 g/m$^2$ as metallic chromium, the laminated polyester resin film is often peeled at the DI working, especially the ironing working, and no good results can be obtained. In the present invention, the presence of the chromium oxide hydrate layer is indispensable for maintaining a good adhesion of the polyester resin coating layer. In the case where a high corrosion resistance is required, in view of the anticorrosive effect or from the economical viewpoint, it is preferred that below the chromium oxide hydrate layer, there be present a plating layer of metallic chromium, tin, nickel, zinc or aluminum, a plating layer of an alloy of such metals or a plurality of plating layers of such metals, or a metal diffusion layer be formed as the surface layer of the steel sheet by heat-treating such a metal plating layer as mentioned above. Preferably, the deposited amount is 0.01 to 0.30 g/m$^2$ as metallic chromium, 0.01 to 5.6 g/m$^2$ as metallic tin, 0.03 to 1.0 g/m$^2$ as metallic nickel, 0.50 to 2.0 g/m$^2$ as metallic zinc or 0.01 to 0.70 g/m$^2$ as metallic aluminum. In the case where a plating layer, alloy layer or metal diffusion layer as mentioned above is formed, if the metal amount is below the above-mentioned lower limit, no substantial anticorrosive effect is attained, and if the metal amount exceeds the upper limit, an effect of highly improving the corrosion resistance is not conspicuous and the continuous productivity of a surface-treated steel sheet is reduced.

In the present invention, it is indispensable that a plating layer of a ductile metal such as tin, nickel, zinc or aluminum should be formed on the surface to be formed into the outer surface of the DI can, where the resin is brought into contact with the ironing die. The reason is that the ductile metal plating layer shows a lubricating effect at the ironing working and renders it possible to perform the ironing working at a high ironing ratio. In view of the general workability at the production of DI cans, it is especially preferred that a tin plating layer be formed. If the tin amount is at least 0.5 g/m$^2$, the DI working is not impeded. The upper limit of the tin amount is not particularly critical, but from the economical viewpoint, it is preferred that the tin amount be up to 11.2 g/m$^2$. The tin plating player may be either a plating layer which has been subjected to a fusion treatment or a plating layer not subjected to a fusion treatment. In order to prevent oxidation of this plating layer, the plating layer may be subjected to a chemical treatment, so far as the ironing property is not degraded. The treatment is sufficient if the plating layer is immersed in a solution of sodium dichromate, as conducted in case of a tinplate sheet for a DI can.

Furthermore, in the present invention, it is indispensable that at the step of laminating the polyester resin film on the above-mentioned surface-treated steel sheet, the steel sheet should be heated at a temperature of from the crystal-melting point of the polyester resin film to a temperature higher by 50° C. than the crystal-melting temperature of the polyester resin film. If the temperature of the steel sheet is lower than the crystal-melting point of the polyester resin film, the polyester film is not tightly bonded to the chromium oxide hydrate film, and at the DI working, the polyester resin film is peeled. If the temperature of the steel sheet exceeds the temperature higher by 50° C. than the crystal-melting temperature of the polyester resin film, the laminated polyester resin film is readily thermally deteriorated, and the barrier property for the content of the can is degraded and the can body is readily corroded. If the polyester resin film used in the present invention is laminated on the steel sheet heated at a temperature of from the crystal-melting temperature of the polyester resin film to the temperature higher by 50° C. than the crystal-melting temperature of the polyester resin film, the polyester resin film is partially or completely rended unoriented or amorphous, and this is preferable for the DI workability. The polyester resin film can be cooled or gradually cooled after the lamination.

In the production of the DI can of the present invention, it is not absolutely necessary that an adhesive should be coated on one surface of the polyester resin film. However, a DI can composed of a steel sheet laminated with a polyester resin film coated with a composition comprising at least one polymer containing at least one group selected from an epoxy group, a hydroxyl group, an amide group, an ester group, a carboxyl group, a urethane group, an acrylic group and an amino group in the molecule in a dry amount of 0.1 to 5.0 g/m$^2$ is preferable because thread-like rusting caused when the DI can is allowed to stand still in a high-temperature and high-humidity atmosphere for a long time can be prevented. If the coated amount is smaller than 0.1 g/m$^2$ in the dry state, the adhesive force is unstable, and if the coated amount is larger than 5.0 g/m$^2$ in the dry state, there is a risk of peeling of the polyester resin coating layer at the forming working of the DI can.

As is apparent from the foregoing description, in the process for the production of a draw-ironed can according to the present invention, the increase of the thickness B of the side wall of the draw cup is controlled to up to 20% of the thickness A, the increase of the thickness C of the side wall of the redrawn cup is controlled to up to 30% of the thickness A and the thickness D of the side wall of the final draw-ironed can is controlled within a specific range at the ironing step, whereby the thickness reduction ratio at the ironing step can be controlled relatively uniformly throughout the side wall of the cup from the bottom to the top. Accordingly, the surface roughness of the final can body is improved and breaking of the barrel is prevented at the ironing step, and a draw-ironed can having improved necking workability and flanging workability can be obtained. Moreover, even when an organic resin-coated sheet is used, the organic resin coating layer is not peeled and cracking is hardly caused, and a draw-ironed can having an excellent corrosion resistance can be obtained.

Examples

Example 1

A tinplate sheet having a thickness of 0.30 mm, a tempering degree of T-2.5 and inner and outer surface deposited with 5.6 g/m$^2$ of tin was draw-ironed under the following forming conditions.

(Forming Conditions)

1. Blank diameter: 123.5 mm
2. Working conditions of first stage drawing
   Draw ratio: 1.82
   Clearance between punch and drawing die: 0.32 mm
   Radius of shoulder of drawing die: 1.0 mm
   Blank-holding force: 1 ton
3. Working conditions of second stage redrawing
   Draw ratio: 1.29
   Clearance between punch and drawing die: 0.30 mm
   Radius of shoulder of redrawing die: 1.0 mm
   Blank-holding force: 1 ton
4. Ironing punch diameter at ironing: 52.64 mm
5. Total ironing ratio: 64.04%

Then, doming and trimming were carried out according to customary procedures, and degreasing and washing were carried out and the inner and outer surfaces were coated. Then, necking and flanging were carried out to obtain a barrel for a two-piece can.

The obtained results are shown in Table 1. No trouble was caused and a good draw-ironed can was obtained.

Example 2

Drawing-ironing working was carried out in the same manner as described in Example 1 except that the radia (R and $R_d$) of the shoulders of the drawing and redrawing dies and the blank-holding forces were changed. The forming conditions adopted were as described below. The obtained results are shown in Table 1.

(Forming Conditions)

1. Blank diameter: 123.5 mm
2. Working conditions of first stage drawing
   Draw ratio: 1.82
   Clearance between punch and drawing die: 0.32 mm
   Radius of shoulder of drawing die: 1.0 mm
   Bland-holding force: 2 ton
3. Working conditions of second stage redrawing
   Draw ratio: 1.29
   Clearance between punch and redrawing die: 0.8 mm
   Blank-holding force: 2 ton
4. Diameter of ironing punch at ironing: 52.64 mm
5. Total ironing ratio: 64.0%

Comparative Example 1

Draw-ironing was carried out in the same manner as described in Example 1 except that the radia (R and $R_d$) of the drawing and redrawing dies, the punch/die clearance and the blank-holding forces were changed to those adopted in the conventional method. The forming conditions were as described below. The obtained results are shown in Table 1.

(Forming Conditions)

1. Blank diameter: 123.5 mm

2. Working conditions of first stage drawing
   Draw ratio: 1.82
   Clearance between punch and drawing die: 0.43 mm
   Radius of shoulder of drawing die: 4.0 mm
   Blank-holding force: 1 ton
3. Working conditions of second stage redrawing
   Draw ratio: 1.29
   Clearance between punch and redrawing die: 0.39 mm
   Radius of shoulder of redrawing die: 2.0 mm
   Blank-holding force: 0.8 ton
4. Diameter of ironing punch at ironing: 52.64 mm
   Total ironing ratio: 64.0%

TABLE 1

| | Example 1 | Example 2 | Comparative Example 1 |
|---|---|---|---|
| Forming of DI Can | | | |
| increase of thickness B (%) | 10.6 | 9.7 | 25.3 |
| increase of thickness C (%) | 16.0 | 15.3 | 33.3 |
| (B–D)/B × 100 (%) | 67.5 | 67.2 | 71.3 |
| (C–D)/C × 100 (%) | 69.0 | 69.3 | 73.0 |
| barrel break ratio (%) | 0 | 0 | 0.9 |
| roughness of inner surface of can (Ra, μm) | 0.10 | 0.15 | 0.25 |
| Necking Working | | | |
| wrinkling ratio (%) | 0 | 0 | 1.5 |
| Flangeing Working | | | |
| flange craking ratio (%) | 0 | 0 | 0.5 |
| Coating | | | |
| coverage of paint | good | good | bad |

Example 3

A laminated sheet was prepared in the following manner.

A film comprising a chromium oxide hydrate layer in an amount of 0.017 g/m$^2$ as metallic chromium as the upper layer and a metallic chromium layer in an amount of 0.10 g/m$^2$ as the lower layer was formed on one surface of cold-rolled band steel sheet having a thickness of 0.30 mm, a tempering degree of T-2.5 and a width of 300 mm by a known electrolytic chromate treatment, and tin was deposited in an amount of 5.6 g/m$^2$ on the other surface. The surface-treated band steel sheet was heated at 220° C. by using a roll heater and a biaxially oriented polyester film (polycondensate of ethylene glycol with 80% of terephthalic acid and 20% of isophthalic acid) having a thickness of 25 μm was laminated on the surface having the chromium oxide hydrate layer, and the laminated steel sheet was immediately cooled with water. The obtained polyester resin-coated steel sheet was subjected to drawing and ironing under the same forming conditions as described in Example 1 so that the inner surface of the DI can was the polyester resin coating surface.

The obtained results are shown in Table 2. It is seen that a DI can having excellent characteristics was obtained.

Example 4

Both the surface of the same cold-rolled band steel sheet as used in Example 3 were deposited with 5.6 g/m$^2$ of tin, and the tin-deposited surface to be formed into the inner surface of the DI can was subjected to a known electrolytic chromate treatment to form a chromium oxide hydrate layer in an amount of 0.007 g/m$^2$ as metallic chromium as the upper layer on the tin layer, followed by water washing and drying. (The tin-deposited surface to be formed into the outer surface of the DI can was subjected to the dipping chromate treatment). The surface-treated band steel sheet was heated at 220° C. by a roll heater. The same polyester resin film as used in Example 3 was coated with a polymer composition under conditions described below, and the coated film was laminated on the surface subjected to the electrolytic chromate treatment. Draw-ironing working was carried out under the same forming conditions as described in Example 2 so that the polyester resincoated surface was formed into the inner surface of the DI can. (Conditions for Coating Polymer Composition on Polyester Resin Film)

Polymer composition: 80 parts of an epoxy resin having an epoxy equivalent of 3000 and 20 parts of a p-cresol type resol. the solid content being 9%
2. Dry weight of polymer composition: 0.2 g/m$^2$
3. Drying temperature after coating of polymer composition: 100° C.

Example 5

One surface of the same cold-rolled band steel sheet was deposited with 3.0 g/m$^2$ of nickel according to known procedures, and the other surface was subjected to a known electrolytic chromate treatment to form a film comprising a chromium oxide hydrate layer in an amount of 0.010 g/m$^2$ as metallic chromium as the upper layer and a metallic chromium layer in an amount of 0.055 g/m$^2$ as the lower layer, followed by water washing and drying (the nickel-deposited surface was subjected to the dipping chromate treatment). The surface-treated band steel sheet was heated at 250° C., and a biaxially oriented polyester film (polycondensate of ethylene glycol with 85% of terephthalic acid and 15% of isophthalic acid) was laminated on the surface subjected to the electrolytic chromate treatment. Draw-ironing was carried out under the same forming conditions as described in Example 1 except that the following changes were made, so that the polyester resin-coated surface was formed into the inner surface of the DI can.

1. Working conditions of first stage drawing
   Clearance between punch and drawing die: 0.30 mm
   Radius of shoulder of drawing die: 0.8 mm
   Blank-holding force: 2 tones
2. Working conditions of second stage redrawing
   Clearance between punch and drawing die: 0.32 mm
   Radius of shoulder of redrawing die: 0.8 mm
   Blank-holding force: 0.8 tone

Example 6

One surface of the same cold-rolled band steel sheet as used in Example 3 was deposited with 0.5 g/m$^2$ of tin according to known procedures and was then deposited with 0.16 g/m$^2$ of nickel according to known procedures, and simultaneously, the other surface was deposited with 3.0 g/m$^2$ of nickel. Furthermore, the two-layer-deposited surface was subjected to a known electrolytic chromate treatment to form a film comprising a chromium oxide hydrate layer in an amount of 0.025 g/m$^2$ as metallic chromium as the upper layer and a metallic chromium layer in an amount of 0.030 g/m$^2$ as the layer, followed by water washing and drying (the thick nickel-deposited surface was subjected to the dipping chromate treatment). A polyester resin film (polycondensate of ethylene glycol with 90% of terephthalic acid and 10% of isophthalic acid) having a thickness of 30 μm was coated with a polymer composition under conditions described below, and the coated film was laminated on the surface subjected to the electrolytic treatment. The obtained polyester resin-coated steel sheet was subjected to draw-ironing working under the same forming conditions as described in Example 1 except that the following changes were made, so that the polyester resin coated surface was formed into the inner surface of the DI can. (Conditions of Coating of Polymer Composition)

1. Polymer composition: 70 parts of an epoxy resin having an epoxy equivalent of 2500 and 30 parts of a polyamide resin (Veranide 115), the solid content being 11%
2. Dry weight of polymer composition: 2.0 g/m$^2$
3. Temperature for drying polymer composition: 80° C.

(Forming Conditions)

1. Working conditions of first stage drawing
   Clearance between punch and drawing die: 0.30 mm
   Radius of shoulder of drawing die: 0.6 mm
2. Working conditions of second stage redrawing
   Clearance between punch and redrawing die: 0.32 mm
   Radius of shoulder of drawing die: 0.8 mm
   Blank-holding force: 0.8 ton Comparative Examples 2 through 5

THE POLYESTER RESIN=COATED STEEL SHEETS OBTAINED IN Examples 3 through 6 were draw-ironed under the same forming conditions as described in Comparative Example 1 so that the polyester resin coated surface was formed into the inner surface of the DI can.

The DI cans having the polyester resin-coated surface as the inner surface, prepared in Examples 3 through 6 and inner surface, prepared in Examples 3 through 6 and Comparative Examples 2 through 5, were evaluated according to the following test methods. The obtained results are shown in Table 2.

(1) Degree of Exposure of Metal to Inner Surface of DI Can

The obtained DI can was degreased, washed and dried and a 1% solution of sodium chloride maintained ar 25° C. was filled in the DI can. A certain voltage of 6.3 V was applied between the DI can as the positive electrode and a stainless rod as the negative electrode, and the degree of exposure of the metal was evaluated based on the flowing electric current (mA).

(2) Storage Test

The obtained DI can was degreased, washed and dried, and the DI can was then subjected to flanging working. Coca Cola was filled in the can to a depth of 90% of the can height. An epoxy-phenolic paint was coated in a dry thickness of 10 μm and baked on an aluminum sheet, and the formed aluminum lid was wrap-seamed to the can. The can was stored at 37° C. for 3 months, and the quantity of dissolved iron was measured and the corrosion state of the side wall of the can was observed.

As is apparent from the foregoing, also in case of a DI can having the polyester resin-coated surface as the inner surface, according to the present invention, barrel breaking is not caused, the necking workability and flanging workability are improved, peeling of the polyester resin coating layer is not caused and cracking is not substantially caused in the polyester resin coating layer is caused, and a draw-ironed can having an excellent corrosion resistance can be obtained.

TABLE 2

| | Example 3 | Example 4 | Example 5 | Example 6 | Comparative Example 2 | Comparative Example 3 | Comparative Example 4 | Comparative Example 5 |
|---|---|---|---|---|---|---|---|---|
| Deposited amount (g/m$^2$) on outer surface | Sn 5.6 | Sn 5.6 | Ni 3.0 | Ni 3.0 | Sn 5.6 | Sn 5.6 | Sn 5.6 | Sn 5.6 |
| Film amount (g/m$^2$) on outer surface | | | | | | | | |
| plating of lowermost layer | not formed | Sn 5.6 | not formed | Sn 0.5 Ni 0.16 | not formed | Sn 5.6 | not formed | Sn 0.5 Ni 0.16 |
| metallic Cr | 0.100 | 0 | 0.055 | 0.030 | 0.100 | 0 | 0.055 | 0.030 |
| Cr oxide hydrate | 0.017 | 0.007 | 0.010 | 0.025 | 0.017 | 0.018 | 0.010 | 0.025 |
| Polyester Film | | | | | | | | |
| thickness (μm) | 25 | **25 | 30 | **30 | 25 | **25 | 30 | **30 |
| softening-initiating temperature (°C.) | 176 | 176 | 192 | 212 | 176 | 176 | 192 | 212 |
| crystal-melting temperature (°C.) | 215 | 215 | 239 | 241 | 215 | 215 | 239 | 241 |
| in-plane orientation coefficient | 0.024 | 0.024 | 0.065 | 0.086 | 0.024 | 0.024 | 0.065 | 0.086 |
| elongation (%) at break | 330 | 330 | 210 | 172 | 330 | 330 | 210 | 172 |
| strength (kg/mm$^2$) at break | 8.2 | 8.2 | 12.3 | 14.5 | 8.2 | 8.2 | 12.3 | 14.5 |
| Forming of DI Can | | | | | | | | |
| increase of B (%) | 10.6 | 9.7 | 4.7 | 1.0 | ← 25.3 → | | | |
| increase of C (%) | 16.0 | 15.3 | 10.3 | 7.0 | ← 33.3 → | | | |
| (B-D)/B × 100 (%) | 67.5 | 67.2 | 65.6 | 64.3 | ← 71.3 → | | | |
| (C-D)/C × 100 (%) | 69.0 | 69.3 | 69.8 | 67.6 | ← 73.0 → | | | |
| Characteristics | | | | | | | | |
| metal exposure (mA) | 0.03 | 0.08 | 0.15 | 0.50 | 31.0 | 29.0 | 342 | 438 |
| amount (ppm) of dissolved iron | 0.02 | 0.05 | 0.23 | 0.65 | 2.5 | 5.2 | 13.0 | 8.5 |
| corrosion state | good | good | good | good | pitting | pitting | pitting | pitting |

Note **: polymer composition was coated on polyester resin film

What is claimed is:

1. A process for the production of a draw-ironed can which comprises:
   (i) draw-forming a metal sheet blank having a thickness A into a preliminarily drawn cup with a side wall having a maximum thickness B while controlling the increase in the thickness B up to 20% of the thickness A, (ii) redrawing the preliminarily drawn cup into a deep-draw-formed cup having a diameter smaller than that of the preliminarily drawn cup, and with the side wall having a maximum thickness C while controlling the increase of the thickness C up to 30% of the thickness A, and (iii) ironing the deep-draw-formed cup into a draw-ironed can with the side wall having a thickness D so that the total ironing ration $R_I$ defined by the following formula:

$$R_I = \frac{A - D}{A} \times 100$$

is at least 40% and that the following requirements:

$$(B-D)/B \times 100 \leqq 70\%, \text{ and}$$

$$(C-D)/C \times 100 \leqq 70\%$$

are satisfied.

2. A process according to claim 1, wherein the process comprises ironing the deep-draw-formed cup in a single stage or a plurality of stages by using a ironing punch and an ironing die in combination, and cooling and lubricating the deep-draw-formed cup and the ironing die, at the ironing stage, using an aqueous lubricant comprising a dispersion of a surface active agent or an oil in water.

3. A process according to claim 1, wherein the side wall of the finally obtained draw-ironed can has an average surface roughness of 0.05 to 0.20 microns.

4. A process according to claim 1, wherein the metal sheet comprises a polyester resin film-laminated thin sheet.

* * * * *